US010646840B2

(12) United States Patent
Untch

(10) Patent No.: US 10,646,840 B2
(45) Date of Patent: May 12, 2020

(54) FRAME FOR CLAMPING A CONTAINER AND METHOD FOR MIXING IN A FLEXIBLE CONTAINER AND CONTAINER FOR CLAMPING

(71) Applicant: Andocksysteme G. Untch GmbH, Badenweiler (DE)

(72) Inventor: Günter Untch, Müllheim (DE)

(73) Assignee: Andocksysteme G. Untch GmbH, Badenweiler (DE)

( * ) Notice: Subject to any disclaimer, the term of this patent is extended or adjusted under 35 U.S.C. 154(b) by 174 days.

(21) Appl. No.: 15/802,143

(22) Filed: Nov. 2, 2017

(65) Prior Publication Data

US 2018/0264423 A1 Sep. 20, 2018

(30) Foreign Application Priority Data

Nov. 2, 2016 (DE) ..... 10 2016 120 898

(51) Int. Cl.
*B65D 35/56* (2006.01)
*B01F 15/00* (2006.01)
(Continued)

(52) U.S. Cl.
CPC .... *B01F 15/00766* (2013.01); *B01F 13/0042* (2013.01); *B01F 13/045* (2013.01);
(Continued)

(58) Field of Classification Search
CPC ..... B65B 69/0091; B65B 69/0075; B65B 69/0083; B65D 33/1641; B65D 31/04; B01F 15/00766
(Continued)

(56) References Cited

U.S. PATENT DOCUMENTS 5,025,925 A 6/1991 Wiklund
2009/0277900 A1 11/2009 Howison
(Continued)

FOREIGN PATENT DOCUMENTS

DE 2409125 9/1975
EP 3287376 2/2018
(Continued)

OTHER PUBLICATIONS

European Patent Office, "European Search Report," issued in European Patent Application No. 17199761.2, German Searching Authority, dated Apr. 4, 2018, document of 11 pages.

*Primary Examiner* — King M Chu
(74) *Attorney, Agent, or Firm* — Akerman LLP; Peter A. Chiabotti

(57) ABSTRACT

A flexible package for storing and transporting bulk goods. Such flexible package can have material-impermeable connections for spreading out sections of the flexible package wall so as to correspond to a predefined shape. One or more docking connections for filling and discharging can be included. The flexible package can have a square bottom and adjacent to the sides thereof triangular stubs as lateral walls. Together, such lateral walls can form an upwardly open pyramid shape. Opposite the bottom, a coupling element can be connected in such a manner that it presents the flexible package so as to be sealable in a standardized manner on open-sided ends of the lateral walls.

3 Claims, 6 Drawing Sheets

(51) Int. Cl.

| | |
|---|---|
| ***B01F 13/04*** | (2006.01) |
| ***B01F 15/02*** | (2006.01) |
| ***B01F 13/00*** | (2006.01) |
| ***B65D 30/08*** | (2006.01) |
| ***B65D 5/00*** | (2006.01) |
| ***B65D 57/00*** | (2006.01) |
| ***B65D 33/16*** | (2006.01) |
| ***B65D 90/20*** | (2006.01) |
| *A61J 1/10* | (2006.01) |
| *A61J 1/16* | (2006.01) |

(52) U.S. Cl.
CPC .... *B01F 15/0085* (2013.01); *B01F 15/00545* (2013.01); *B01F 15/0217* (2013.01); *B65D 5/008* (2013.01); *B65D 31/04* (2013.01); *B65D 33/1641* (2013.01); *B65D 57/00* (2013.01); *B65D 90/205* (2013.01); *A61J 1/10* (2013.01); *A61J 1/16* (2013.01); *B65D 2217/00* (2013.01)

(58) Field of Classification Search
USPC ..... 206/219
See application file for complete search history.

(56) References Cited

U.S. PATENT DOCUMENTS

2014/0029872 A1* 1/2014 Ness ..... B65D 33/06 383/12
2018/0057287 A1 3/2018 Snape

FOREIGN PATENT DOCUMENTS

EP 3287376 A1 * 2/2018 ..... B65B 69/0083
WO 2011144912 11/2011

* cited by examiner

FRAME FOR CLAMPING A CONTAINER AND METHOD FOR MIXING IN A FLEXIBLE CONTAINER AND CONTAINER FOR CLAMPING

CROSS-REFERENCE TO RELATED APPLICATIONS

This application claims priority to German Patent Application No. 10 2016 120 898.1, filed Nov. 2, 2016, which is incorporated by reference in its entirety.

SUMMARY

Container mixers are known which are specially designed for a mixing process that is gentle to the product, and for a flexible reception of various mixing containers, such as for example in the pharmaceutical sector. A hydraulic spreading out system ensures reception of the mixing containers. A PLC and recipe controlled mixing process allows an adaptation to the product to be mixed. The reception of different container sizes or adapters for drums and small containers can be realized using a spreading beam system. As handling functions, lifting, lowering, rotating, pivoting of a mixer column are required. Users expect such a mixing technology to provide for automatic loading and unloading. It should be possible to use a chopper in the mixing container. A spray system for applying liquids onto the mix, weighing technology provided upstream and downstream, metered discharging, an NIR system, etc., are to be employed. The requirement altogether is: reproducible mixing in a closed system.

To this end, known mixing containers are made for example from stainless steel. Mixing containers vary with regard to their basic dimensions and their height, free-standing or floor/ceiling supported versions. According to the prior art, the loading of the mixing container may be carried out by means of trolleys, pallet trucks up to fully automated roller conveyor loading and unloading. Different container clamping systems of a manual up to a fully automated version are then used for securely clamping the mixing container to the known mixing device. A safety housing is provided as a function of the installation location and the process flow. After clamping, a standard inclined orientation relative to the mixing axes should have been achieved.

In the head space of the container, no additional fittings are to be present. An integration of upstream and/or downstream processes as well as handling functions (lifting, tilting, pivoting, setting down, docking etc.) is required, as well as a highly level of availability, since the cleaning of the known mixing container is carried out outside of the mixer. Frequently, an exposure-proof version is required.

The materials to be mixed in a reproducible manner are often supplied in flexible packages which then have to be filled into two mixing containers. So far, mixing containers had to be emptied into further packages after mixing and then cleaned. It is the object of the present disclosure to simplify these processes without jeopardising reproducibility.

To this end it is proposed to allow mixing in a "single-use bag", which should be carried out in a manner comparable with known small batch mixers as described above. The flexible package, in which the material to be mixed is supplied, should already meet certain preconditions at the entry stage. Namely, it should be possible to clamp it into a frame in such a way that at least sections of the flexible package walls adopt a predefined shape which the mixing container should assume prior to the start of the mixing process, so as to be able to mix in a reproducible manner.

A flexible package, which is for example already a storage and transport package, can be used as a mixing container, by clamping the flexible packaging into a frame for mixing, so that at least almost solid walls and bottoms are formed and a reproducible mixing process is achieved in this package that is now at least not completely flexible any longer. For this mixing process in fixed containers has been multiply validated and the process security is therefore maintained if according to the present disclosure the need to empty the flexible transport container into a mixing container is eliminated, but rather the flexible transport container itself becomes the mixing container.

Accordingly, the need of washing transport containers or mixing containers is totally eliminated, with no need for container washing machines any more etc.

To this end, the present disclosure proposes for example a frame having four identical lateral portions made from stainless steel sheet. During making up, the flexible package shaped in a preferred manner, which has four lateral pockets, is mounted in the frame from the top and is securely clamped in the bottom region. In this way, similar conditions as in the known stainless steel container as mixing container are provided for the mixing process.

A process according to the present disclosure, in particular for mixing bulk goods in a flexible package, advantageously uses a flexible package and a frame according to the present disclosure, in order to save altogether for example costs and efforts, whilst at the same time still meeting reproducibility requirements.

An advantageous embodiment of a frame for receiving the single use package has generally triangular lateral wall elements 12 that are supported in the frame in a manner so as to be rotational about a bottom base. The upper free end 14 of the respective lateral wall element 12 is shaped in a congruent manner for receiving a top end of the package. Particularly preferably, the four upper free ends can be connected as a ring around a flange, which at the same time effects a "holding taut" of package walls by means of the lateral wall elements 12 formed as clamping surfaces.

BRIEF DESCRIPTION OF THE DRAWING

The present disclosure will be explained in more detail below with reference to an embodiment example shown in the figures, wherein.

DETAILED DESCRIPTION

Figure 1:
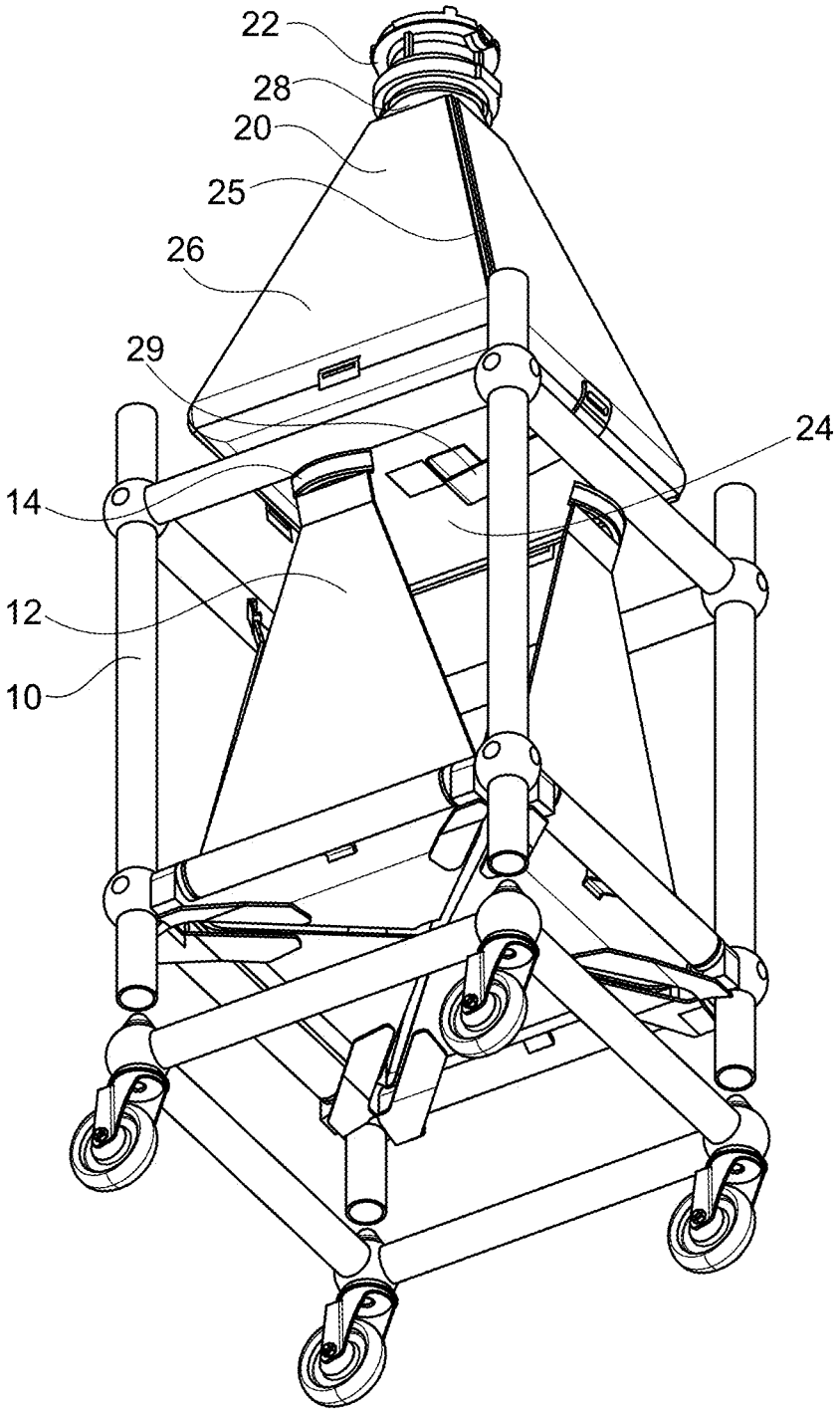
FIG. 1 shows a perspective view of a flexible package, which is provided above a frame with opened clamping surfaces for clamping the flexible package, with the frame being shown above a movable cart.
Figure 2:
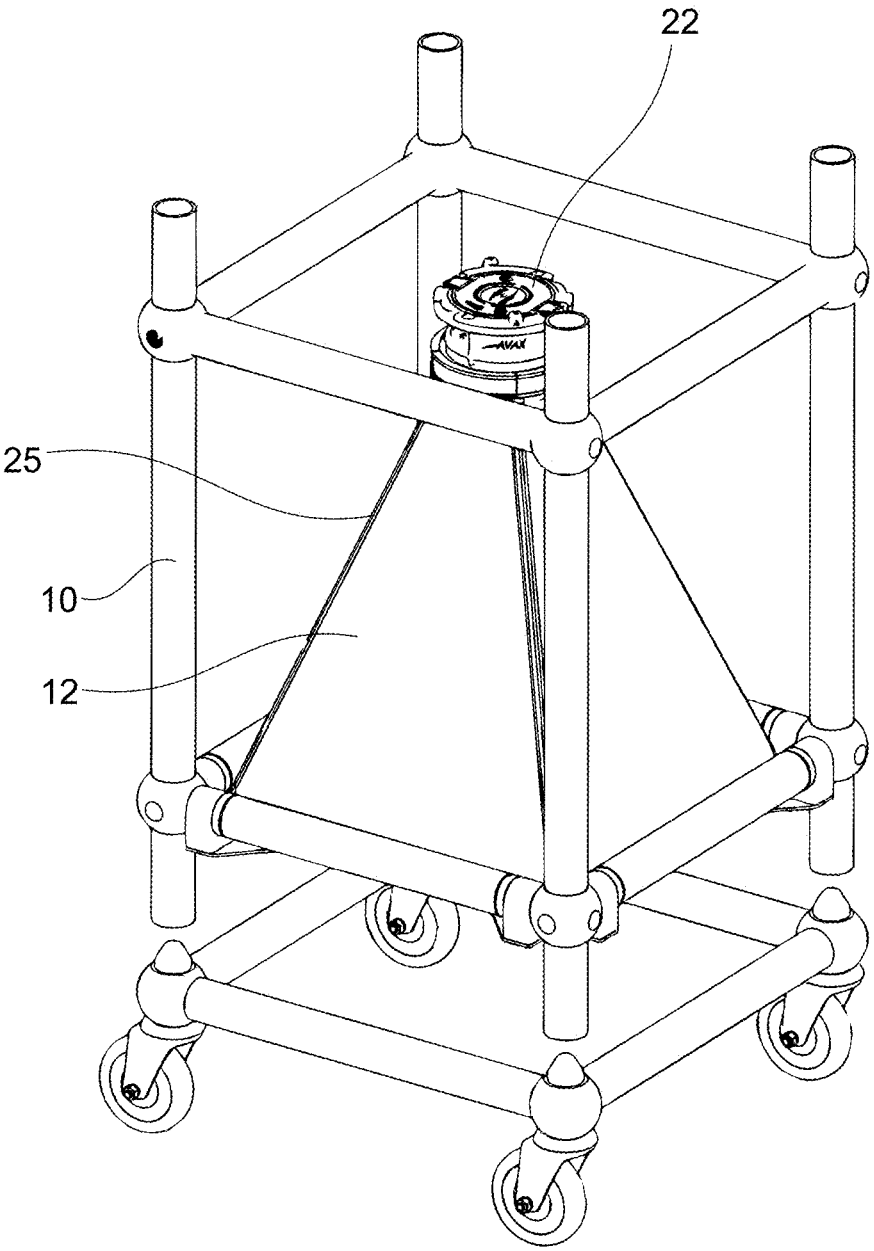
FIG. 2 shows the frame with the movable cart from FIG. 1 having clamping surfaces closed around the flexible package.
Figure 3A:
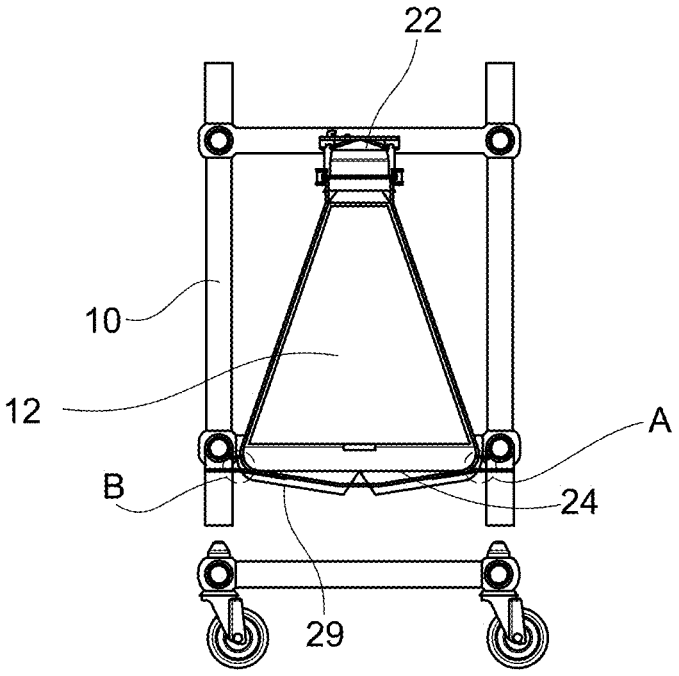
FIG. 3A shows a lateral view onto a flexible package inserted into the frame from FIG. 1 (the obscuring frame side is hidden) with detailed views in FIG. 3B and in FIG. 3C, FIG. 4A and FIG. 4B show a lateral view and a perspective view of a flexible package without a frame.
Figure 3B:
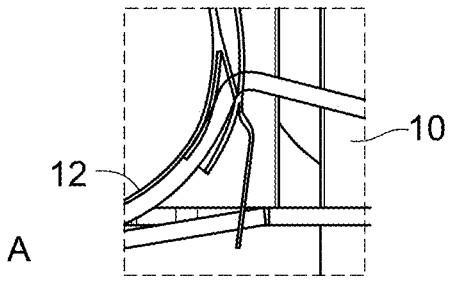
Figure 3C:
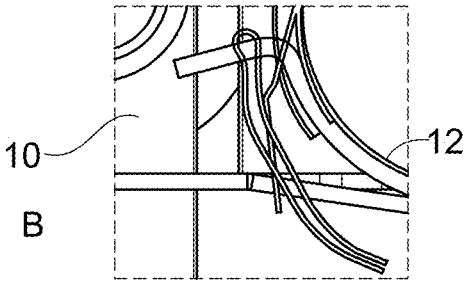
Figure 4A:
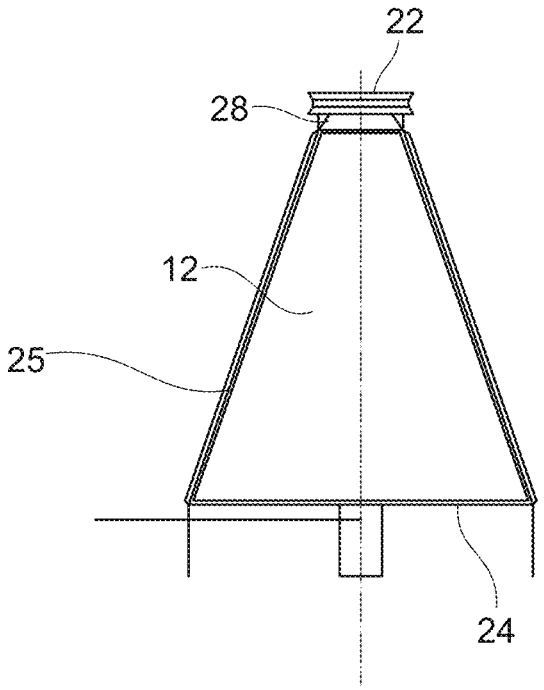
Figure 4B:
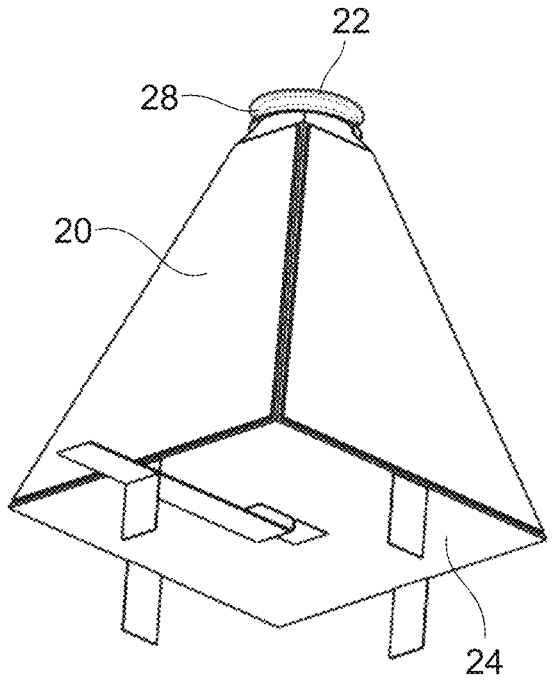
Figure 5A:
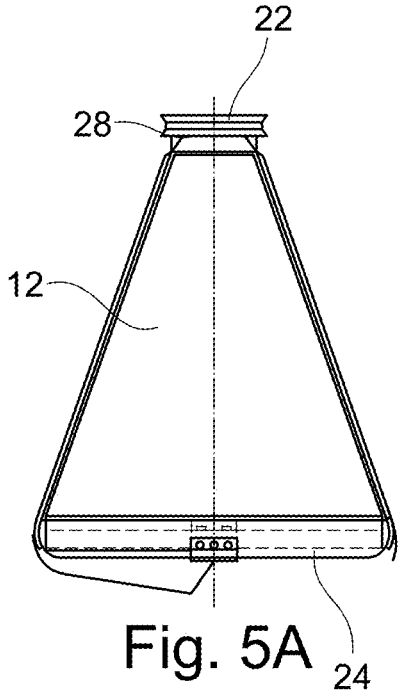
FIG. 5A and FIG. 5B show two lateral views, turned 90° towards each other, of a further example of a flexible package.
Figure 5B:
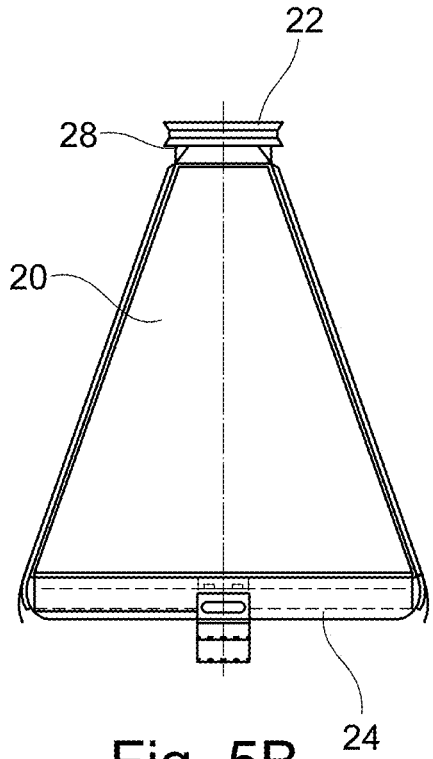
Figure 6:
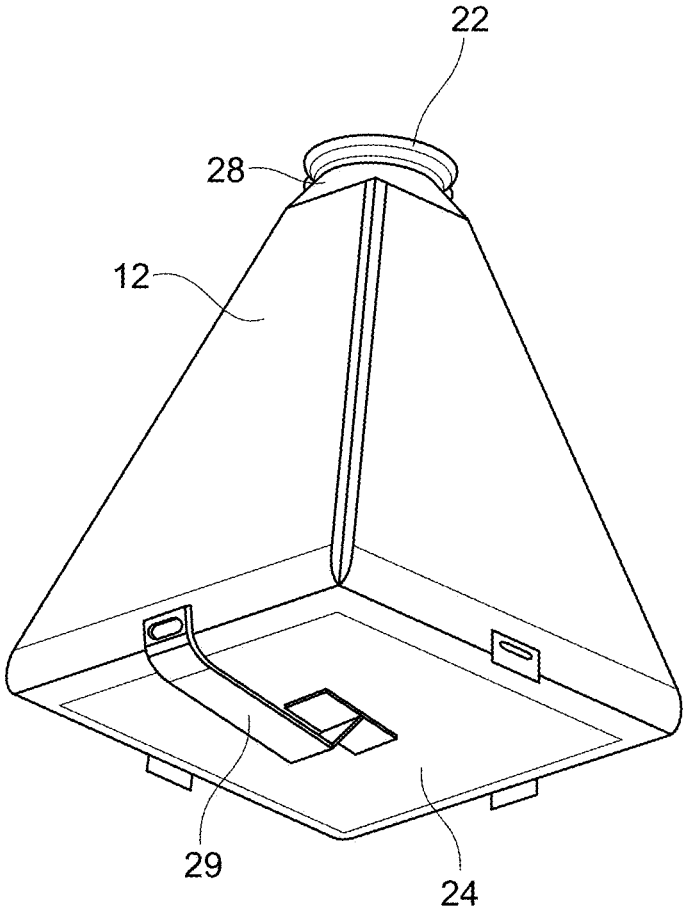
FIG. 6 shows a perspective view of the flexible package from FIG. 5 at an angle from the bottom with a seam course in the bottom.

An embodiment example of a frame 10 according to the present disclosure is shown in FIGS. 1 to 3. The flexible package 20 is shown in two embodiment variants, however any one of the figures shows just one variant, in FIGS. 4 to 6 separately without a frame.

The present disclosure is based on the concept of using such a flexible package 20 as a mixing container of a validated mixing process. Since the flexible package 20 cannot stand on its own, not even after filling, in this rigid form, the present disclosure proposes to design engagement locations or surfaces on the flexile package 20 in such a way that it can at least partially be spread out. Insofar, the illustrations might create the impression to a viewer that the package stands unaided in this form. This is however not the case.

According to the present disclosure, to this end the flexible package 20 is clamped into a frame 10.

At least some sections of the wall, preferably however the complete wall in a laterally circulating manner and the bottom 24, are spread out in such a way that according to the views, the flexible package 20 adopts planar wall areas. To this end, various flaps 29 may be provided at the bottom, see FIG. 8, although for the sake of clarity FIG. 8 only shows a single one. Preferably, flaps 29 are fixed to the bottom lateral edges so as to be suspended therefrom, which flaps 29 have for example a central hole provided therein. These flaps 29 shown suspended may be hooked onto struts of the frame (not shown).

Apart from these connections, which do not allow any material to permeate into the inside of the package 20, for spreading out at least some sections of the wall so as to correspond to a pre-defined form, the package 20 has at least one docking connection 22 for filling and discharging. To this end, a coupling element 22 is shown that in a simple form may simply be a ring. However, such an opening may be provided not only at the top but also at the bottom. It must be possible to vent the package 20 in a controlled manner in order to achieve its desired form. To this end, the package 20 preferably has a valve opening or a pressurized gas connection. Thus, for example, means for metering inert gas is provided. After discharging, the flexible packages 20 according to the present disclosure have to be discarded. In order to provide improved controllability of such waste, a controlled evacuation through the above-mentioned openings can be achieved.

In order to improve explosion security, according to the present disclosure both the package 20 and the frame 10 are equipped with grounding lugs.

The shown embodiment example of the package according to the present disclosure has a square bottom 24 and, adjacent to the sides thereof, triangular stubs as lateral walls 26. Together, they form an upwardly open pyramid shape. The present disclosure also includes other shapes, such as spheres or octahedrons, which may be at least partially approximated with respect to their basic shapes by spreading out according to the present disclosure at least partial surfaces of the package 20.

Opposite the bottom 24, the flexible package 20 presents, according to the illustrations, a coupling element 22 in a manner so as to seal the flexible package 20 in a standardized manner connected to its opening-sided ends 28 of the lateral walls 26.

According to preferred embodiments of the package 20, for an outward spreading out of partial surfaces, pockets 25 are provided as longitudinal guides which follow the connection lines between the lateral walls 26, into which pockets rods of the frame may be inserted, preferably when lowering the package 20 into the frame 10. The rods (not shown) are preferably supported in a manner as to be rotatable at the bottom 24 about a strut of the frame 10. At the top, they have free ends after the opening up, which are latched into the coupling element.

However, the frame 10 can also be forced into a certain shape by just using clamping surfaces of the frame 10.

Accordingly, the present disclosure allows the handling of bulk goods without any further filling into standardized steel containers. The present disclosure mentions by way of example the mixing of bulk goods in a flexible package 20, which flexible package is spread out in a frame 10 so as to forcibly assume, at least almost, a predefined body shape. The frame 10 is then moved into the mixer in a manner in which otherwise the known rigid mixing containers would have to be clamped.

Advantageous methods according to the present disclosure ensure a clinging on or otherwise spreading out of the lateral walls 26 and/or the bottom 24 of the flexible package 20 to form flat partial surfaces.

This specification has been written with reference to various non-limiting and non-exhaustive embodiments or examples. However, it will be recognized by persons having ordinary skill in the art that various substitutions, modifications, or combinations of any of the disclosed embodiments or examples (or portions thereof) may be made within the scope of this specification. Thus, it is contemplated and understood that this specification supports additional embodiments or examples not expressly set forth in this specification. Such embodiments or examples may be obtained, for example, by combining, modifying, or reorganizing any of the disclosed steps, components, elements, features, aspects, characteristics, limitations, and the like, of the various non-limiting and non-exhaustive embodiments or examples described in this specification. In this manner, Applicant reserves the right to amend the claims during prosecution to add features as variously described in this specification.

What is claimed:

1. A flexible package storing and transporting bulk goods, wherein the flexible package comprises:

material-impermeable connections for spreading out wall sections of the flexible package so as to correspond to a shape and at least one docking connection for filling and discharging; and a rectangular bottom and triangular stubs adjacent to sides of the bottom, the bottom and the triangular stubs forming lateral walls, so that the bottom and the triangular stubs form together an upwardly open pyramid shape, and that opposite the bottom, a coupling element is connected in such a manner that the coupling element presents the flexible package so as to be sealable on open-sided ends of the lateral walls.

2. The flexible package as claimed in claim 1, wherein outside of the package ready for spreading out, pockets are provided as longitudinal guides, which pockets follow connection lines between the lateral walls.

3. A device, comprising:

a frame for adopting a flexible package for storing and transporting bulk goods, wherein the flexible package has material-impermeable connections for spreading out wall sections of the flexible package so as to correspond to a shape and at least one docking connection for filling and discharging, wherein the flexible package has a rectangular bottom and triangular stubs adjacent to sides of the bottom, the bottom and the triangular stubs forming lateral walls, so that the bottom and the triangular stubs form together an upwardly open pyramid shape, and that opposite the bottom, a coupling element is connected in such a manner that the coupling element presents the flexible package so as to be sealable on open-sided ends of the lateral walls, wherein the frame forces the flexible package into a package shape.

* * * * *